US006230919B1

(12) United States Patent
Guillin

(10) Patent No.: US 6,230,919 B1
(45) Date of Patent: May 15, 2001

(54) PACKAGING CASE COMPRISING A CROWN

(75) Inventor: Francois Guillin, Mouthier Hautepierre (FR)

(73) Assignee: Groupe Guillin, Ornans (FR)

( * ) Notice: Subject to any disclaimer, the term of this patent is extended or adjusted under 35 U.S.C. 154(b) by 0 days.

(21) Appl. No.: 09/462,887

(22) PCT Filed: Jul. 17, 1998

(86) PCT No.: PCT/FR98/01567

§ 371 Date: Jan. 18, 2000

§ 102(e) Date: Jan. 18, 2000

(87) PCT Pub. No.: WO99/03739

PCT Pub. Date: Jan. 28, 1999

(30) Foreign Application Priority Data

Jul. 18, 1997 (FR) ..... 97 09162
Oct. 1, 1997 (FR) ..... 97 12200

(51) Int. Cl.[7] ..... B65D 5/32

(52) U.S. Cl. ..... 220/315; 220/4.21; 229/122.22; 206/434

(58) Field of Search ..... 220/4.21, 4.24, 220/315, 318, 319, 780, 796; 229/118, 122.21, 122.23; 206/434, 548, 549, 545; 40/312

(56) References Cited

U.S. PATENT DOCUMENTS 3,326,408 * 6/1967 Ringlen ..... 220/4.24
3,670,881 6/1972 Dutcher .
3,675,811 * 7/1972 Artz ..... 220/4.24
4,272,010 * 6/1981 Capo .
4,699,291 * 10/1987 Prais et al. ..... 220/319
5,540,381 * 7/1996 Davis ..... 206/434 X
5,833,116 * 11/1998 Guillin .
5,860,530 * 1/1999 Simmons et al. .
5,921,392 * 7/1999 Davis ..... 206/434
5,964,365 * 10/1999 Peeples et al. ..... 220/319 X
5,975,412 * 11/1999 Guillin ..... 220/4.21

FOREIGN PATENT DOCUMENTS 25 21 252 4/1977 (DE) .
32 16 718 12/1982 (DE) .
0123456-A2 * 1/2000 (EP) ..... 100/100
2 741 324 5/1997 (FR) .

* cited by examiner

*Primary Examiner*—Nathan J. Newhouse
(74) *Attorney, Agent, or Firm*—Young & Thompson

(57) ABSTRACT

The invention concerns a packaging case, comprising a closed crown (5) provided with at least two opposite transverse windows (6), a thermoformed base (1) and a thermoformed lid (2) mounted removable on the base (1). The base (1) or the lid (2) has a peripheral opening provided with an extremity (3) projecting outwards with which the lid (2) or base (1) peripheral edge co-operates respectively for closing the packaging case, the crown (5) is arranged along the outer wall of the part, base (1) or lid (2) provided with said extremity (3), the crown (5) being locked in position by means of locking members (7, 8) co-operating with said windows (6). The invention is applicable to packaging cases for food products.

10 Claims, 3 Drawing Sheets

PACKAGING CASE COMPRISING A CROWN

Figure 1:
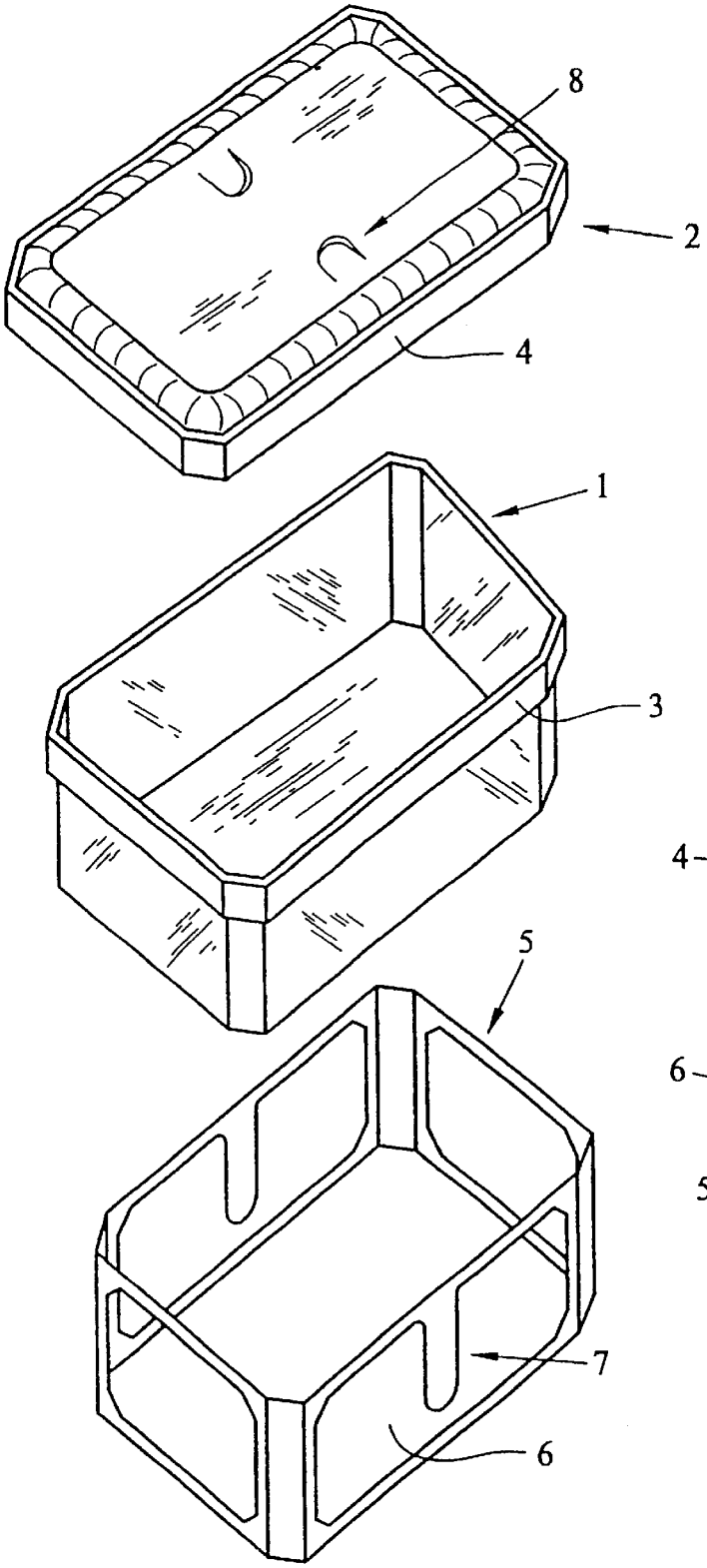

The present invention relates to a packaging box or small container, in particular for food products, of the type comprising a closed crown provided with at least two opposite transverse windows, a thermoformed bottom and a thermoformed cover mounted detachably on the bottom.

Packaging boxes, in particular but not exclusively of transparent plastic material, have had increasing success in the food field because the moderate cost permitted by thermoforming synthetic material. Thus, the development of mass vending, and also rapid service, requires economical and hygienic packaging, which lets the contents be seen.

Known packaging in the form of small containers provided with a cover, however suffer from a certain poor appearance due to the difficulty of applying a label or a decoration. Thus, only the cover in fact is available for such a label which will be glued externally onto the cover, or simply disposed in the box so as to be readable from outside, through the cover.

There are also known boxes for food products using a crown, for example of cardboard or synthetic material, provided with windows. In the case of a box of this type according to FR-A-2 741 324, the crown bears and locks against the bottom and the cover which are articulated by means of a connecting member, the assembly forming a triptych. Such a structure, if it is satisfactory for large boxes such as pastry boxes, is not suitable for small boxes or small containers. Moreover, thermoforming of the triptych can be costly in material.

In French patent application No. 97 00292 (not published at the date of the present application), there has been proposed a packaging box in which the bottom and/or the cover are in the form of a triptych and enclose an internal crown provided with windows. This box is again complicated and costly to produce and use.

Another drawback common to packaging boxes which have been described, is the difficulty of reuse of the box after opening, because the triptych or triptychs must be carefully restored in place with the crown for such a reuse.

Still another drawback resides in the presence of the crown within the packaging, which can be the cause of pollution of the contents.

The present invention accordingly seeks to provide a new packaging of the type indicated in the introduction, which does not have the drawbacks of known packages. In particular, the packaging according to the present invention must be economic to produce, to use and to reuse, as well as not giving rise to the risk of pollution of the contents.

To this end, the packaging box according to the invention is characterized in that the bottom or the cover have a peripheral opening provided with an outwardly projecting return with which coacts the peripheral edge of the cover or bottom respectively, for closing the packaging box, the crown being disposed along the external wall of the piece, bottom or cover, provided with said return, in abutment against said return, said crown being locked in position by means of locking members coacting with said crown.

The packaging box according to the invention has all the advantages of presentation, use and reuse, of a conventional box such as a small container, whilst benefitting from the decorative crown and/or marking locked on the exterior without risk of pollution of the contents.

According to a first embodiment of the invention, the locking members coact with the windows of the crown.

Thus, according to one form of this first embodiment of the invention, the return is secured to the bottom, one edge of each of the opposite windows of the crown comprising a bendable tongue coacting with a locking means.

According to one embodiment, said locking means is constituted by a snap engagement cutout formed in the cover.

As a modification, said locking means comprises a first member at the free end of a tongue complementary to a second member formed at the free end of the other tongue.

According to a second form of this first embodiment of the invention, the locking members comprise at least one tongue formed flap of the piece having no return and coacting with the upper edge of the window of the crown.

As a modification, said tongue coacts with a cut provided in the peripheral wall of the piece comprising the return, adjacent the upper edge of a window adjacent said return.

In a second embodiment of the invention, the crown comprises at least two through openings, separate from the windows, provided adjacent the edge of the crown coming into abutment against the return of the piece, bottom or cover, and through each of which engages a locking member of said piece, bottom or cover, said locking member being positioned in the external wall of the piece below said return, the flange of the other piece, cover or bottom, forming a snap-in edge below the free end of the return of the bottom or cover.

According to one form of this second embodiment, said blocking members are constituted by projections, projecting from the external wall of the piece, bottom or cover, outwardly, said snap-in edge of the other piece, cover or bottom, constituting the complementary locking members.

Figure 2:
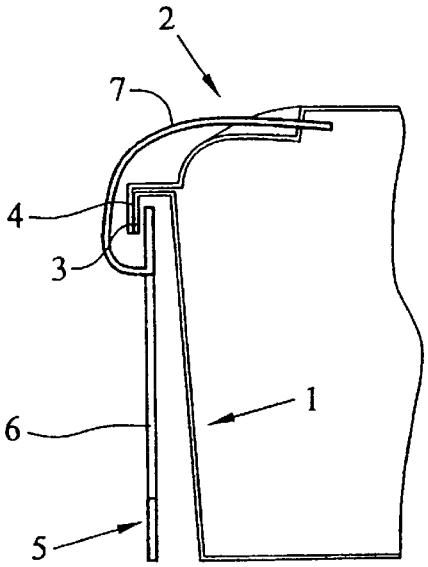
Figure 3:
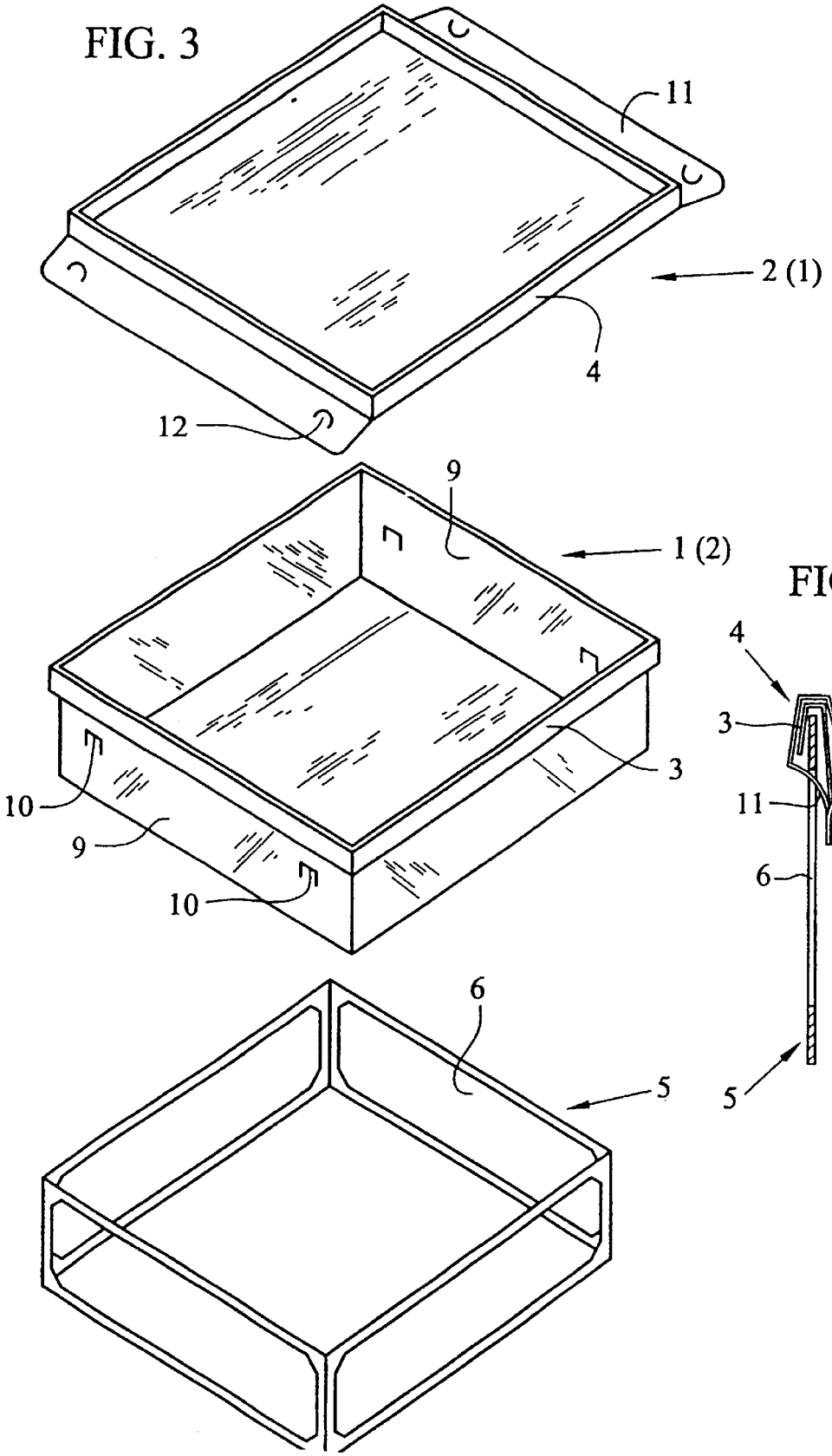
Figure 4:
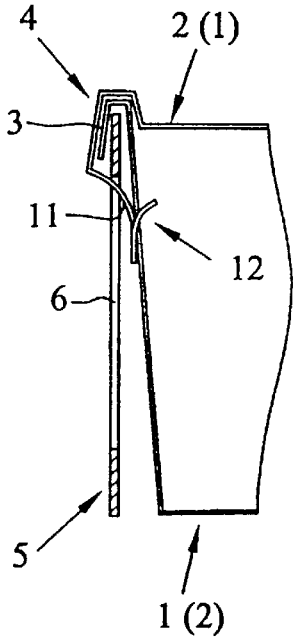
Figure 6:
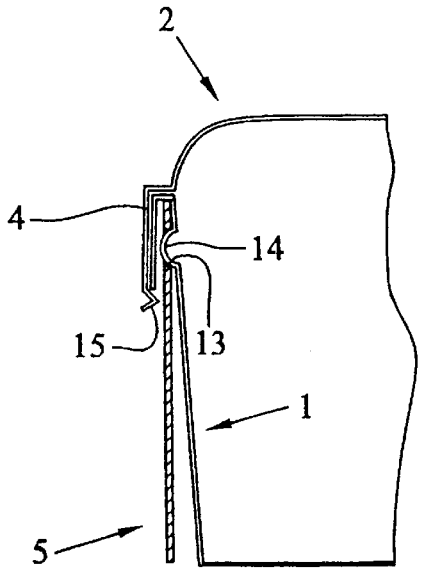
Figure 5:
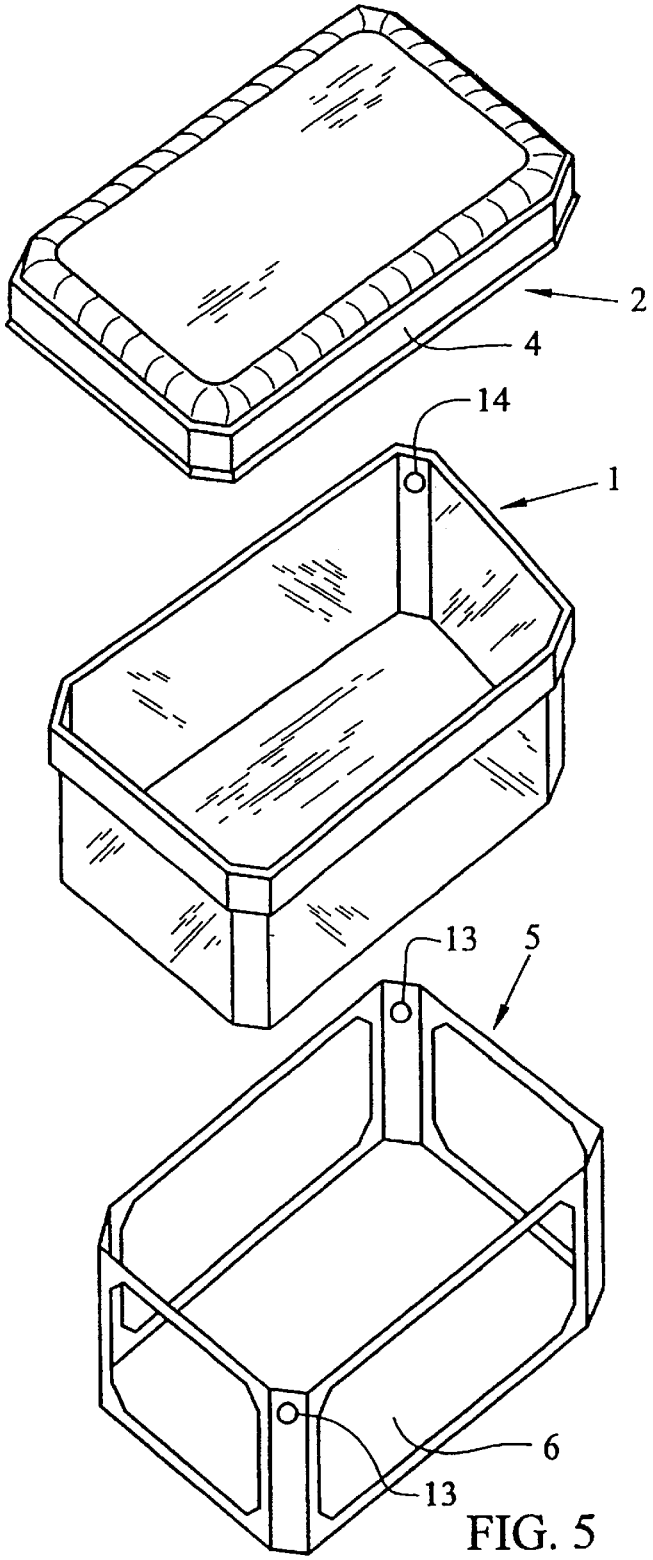

The invention will be better understood from a reading of the following description of embodiments, with reference to the accompanying drawings, in which:

FIG. 1 is an exploded perspective schematic view before assembly, of a small container according to one embodiment, FIG. 2 is a schematic transverse cross-sectional view of a portion of the small container of FIG. 1, FIG. 3 is similar to FIG. 1, for a modification of the packaging box, FIG. 4 is analogous to FIG. 2, for the modification of FIG. 3, FIG. 5 is analogous to FIG. 1, for a modification of a packaging box, and FIG. 6 is analogous to FIG. 2, for the modification of FIG. 5.

Reference will first be had to FIGS. 1 and 2. The box is constituted by a bottom 1 closed by a cover 2. The bottom 1 comprises a return 3 projecting outwardly with which coacts a flange 4 on the cover 1 to close the box, thereby forming what can be called a small container. The pieces, bottom 1 and cover 2, are of thermoformed transparent, translucent or opaque plastic material.

According to the invention, a crown 5, comprising at least two opposite windows 6, is disposed about the external wall of the bottom 1, in abutment against the interior of return 3. The crown 5 can be of cardboard or of rigid synthetic material.

The windows 6 each comprise, extending from their upper edge, a bendable tongue 7. In the illustrated example, each tongue 7 is snapped, after bending (FIG. 2), into a snap-fit cut 8 provided in the cover 2. The free end of the tongue 7 can be profiled, for example in the form of a double fishhook, to be locked into cut 8.

According to a modification (not shown), the ends of the tongues are shaped, for example in the form of hooks, to constitute complementary locking means.

In the embodiment of FIGS. 3 and 4, the same reference numerals designate the same elements as in FIGS. 1 and 2, taking account that the cover 2 can constitute the bottom of a box and the bottom 1 can constitute a cover in the form of a bell.

The piece 1, which forms the bottom in the illustrated embodiment, is analogous to bottom 1 of FIGS. 1 and 2 but has moreover, in its sidewalls 9 adjacent to the windows 6 of the crown 5, at least one cut 10 adjacent the upper edge of the corresponding window 6. The piece 2 forming, in the illustrated example, the cover, is provided with two flaps 11 adapted to be bent partially against the wall 9 of the piece 1. The flaps 11 comprise at least one tongue 12 coacting with the cut 10 to trap the crown 5 through the window 6. The crown 5 in this case has no bendable tongues.

According to a modification (not shown), the tongue 12, which could in this case be constituted by a fold of the corresponding flap 11, is arranged to be slid below the upper edge of the window 6.

In the embodiment of FIGS. 5 and 6, the same reference numerals designate the same elements as in FIGS. 1 and 2, taking account that the cover 2 can constitute the bottom of a box and the bottom 1 can constitute its cover in the form of a bell. In the illustrated example, the crown 5 has four windows 6.

The crown 5 is disposed about the external wall of the bottom 1, in abutment adjacent the interior of the return 3. This crown 5 has through openings 13 separate from the windows 6 and arranged adjacent the edge of the crown 5 coming into abutment with the interior of the return 3, preferably on opposite sides of each window 6 in the vicinity of a lateral edge of said window 6. Once the crown 5 is emplaced about the bottom 1, said openings 13 are thus positioned below said return 3.

In the wall of bottom 1 located facing the return 3, are provided locking members such as the bosses 14, projecting toward the return 3 so as to engage through the openings 13 of the crown 5 when the latter is emplaced.

So as to lock said crown 5 in place, the cover 2 has on its flange 4 a snap-in edge 15 below the free end of the return 3 of the bottom 1.

The crown 5 can be of cardboard or of rigid synthetic material.

In all cases, and contrary to what is shown in FIGS. 2 and 4 for simplicity of the drawing, the crown 5 has a shape complementary to that of the peripheral wall of the piece 1 about which it is disposed. The piece 1 has, because of the process of production by thermoforming, at least one shape that is slightly truncated conical such that the crown 5 is thus tightly applied against the peripheral wall of this piece 1.

What is claimed is:

1. Packaging box or small container, in particular for food products, of the type comprising a closed crown (5) provided with at least two opposite transverse windows (6), a thermoformed bottom (1) and a thermoformed cover (2) detachably mounted on the bottom (1), characterized in that the bottom (1) or the cover (2) has a peripheral opening provided with a return (3) projecting outwardly with which coacts the peripheral edge of the cover (2) or the bottom (1) respectively, to close the packaging box, the crown (5) being disposed along the external wall of the piece, bottom (1) or cover (2) provided with said return (3), in abutment against said return (3), said crown (5) being locked in position by means of locking members (7, 8; 10, 12; 14) coacting with said crown (5).

2. Packaging box according to claim 1, characterized in that the locking members (7, 8; 10, 12) coact with the windows (6) of the crown (5).

3. Packaging box according to claim 2, characterized in that the return (3) is secured to the bottom (1), an edge of each of the opposed windows (6) comprises a bendable tongue (7) coacting with a locking means (8).

4. Packaging box according to claim 2, characterized in that said locking means is constituted by a snap-in cut (8) formed in the cover (2).

5. Packaging box according to claim 2, characterized in that said locking means comprises a first member formed at the free end of a tongue (7) complementary to a second member formed at the free end of the other tongue (7).

6. Packaging box according to claim 2, characterized in that the locking members comprise at least one tongue (12) formed in a flap (11) of the piece (2) not comprising the return and coacting with the upper edge of a window (6) of the crown (5).

7. Packaging box according to claim 2, characterized in that the locking members comprise at least one tongue (12) formed in a flap (11) of the piece (2) that does not comprise the return and said tongue (12) coacts with a cut (10) provided in the peripheral wall (9) of the piece (1) comprising the return (3), adjacent the upper edge of a window (6) adjacent said return (3).

8. Packaging box according to claim 2, characterized in that the piece, bottom (1) or cover (2), comprising the return (3) has a peripheral wall of a shape complementary to that of the crown (5).

9. Packaging box according to claim 1, characterized in that the crown (5) comprises through openings (13), separate from the windows (6) and provided adjacent an edge of the crown (5) that comes into abutment against the return (3) of the piece, bottom (1) or cover (2), and through each one of which engages a locking member (14) for said piece, said locking member (14) being positioned in the external wall below said return (3), the flange (4) of the other piece, cover (2) or bottom (1), comprising one snap-in edge (15) below the free end of the return (3) of the piece, bottom (1) or cover (2).

10. Packaging box according to claim 9, characterized in that said locking members are constituted by bosses (14) and the complementary locking members are constituted by the snap-in edge (15) of the other piece, cover (2) or bottom (1).

* * * * *